US007009103B2

(12) United States Patent
Pitschi

(10) Patent No.: US 7,009,103 B2
(45) Date of Patent: Mar. 7, 2006

(54) COAXIAL LINE HAVING FORCED COOLING

(75) Inventor: Franz Pitschi, Rottach-Egern (DE)

(73) Assignee: Spinner GmbH, Munich (DE)

( * ) Notice: Subject to any disclaimer, the term of this patent is extended or adjusted under 35 U.S.C. 154(b) by 5 days.

(21) Appl. No.: 10/814,131

(22) Filed: Apr. 1, 2004

(65) Prior Publication Data

US 2005/0067175 A1 Mar. 31, 2005

(30) Foreign Application Priority Data

Apr. 2, 2003 (DE) ..... 103 15 021
May 19, 2003 (DE) ..... 103 22 482

(51) Int. Cl.
*H01B 9/06* (2006.01)

(52) U.S. Cl. ..... 174/15.1; 174/15.6

(58) Field of Classification Search ..... 174/15.6, 174/15.4, 21 R, 26 R, 28, 102 R, 103, 106 R, 174/125.1, 126.1, 126.2
See application file for complete search history.

(56) References Cited

U.S. PATENT DOCUMENTS 3,331,911 A * 7/1967 Whitehead ..... 174/22 R
3,749,811 A * 7/1973 Bogner et al. ..... 174/15.5
3,902,000 A * 8/1975 Forsyth et al. ..... 174/15.3
3,946,141 A * 3/1976 Schmidt ..... 174/11 R
4,053,700 A * 10/1977 Meyer ..... 174/21 C
4,323,720 A * 4/1982 Orgeret ..... 174/21 JS
4,370,511 A * 1/1983 Cookson et al. ..... 174/14 R
6,166,323 A * 12/2000 Kelch et al. ..... 174/21 R
6,512,311 B1 * 1/2003 Metra et al. ..... 307/147
6,743,984 B1 * 6/2004 Nassi et al. ..... 174/125.1

FOREIGN PATENT DOCUMENTS

DE 196 13 026 A * 10/1997
DE 10108843 A1 1/2002

* cited by examiner

*Primary Examiner*—William H. Mayo, III
(74) *Attorney, Agent, or Firm*—Edell, Shapiro & Finnan, LLC

(57) ABSTRACT

A coaxial line includes an inner conductor, an outer conductor, and a series of insulating material struts located between the inner and outer conductors. At least some of the struts include conduits through which coolant may be supplied and removed. The line further includes connections that permit coolant to be sent through the line. In operation, coolant flows through the connections, along the struts, and into the inner conductor, cooling the coaxial line.

20 Claims, 11 Drawing Sheets

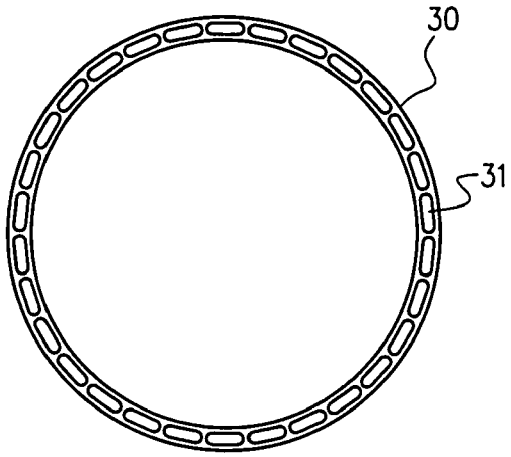
Fig.11
Fig.12
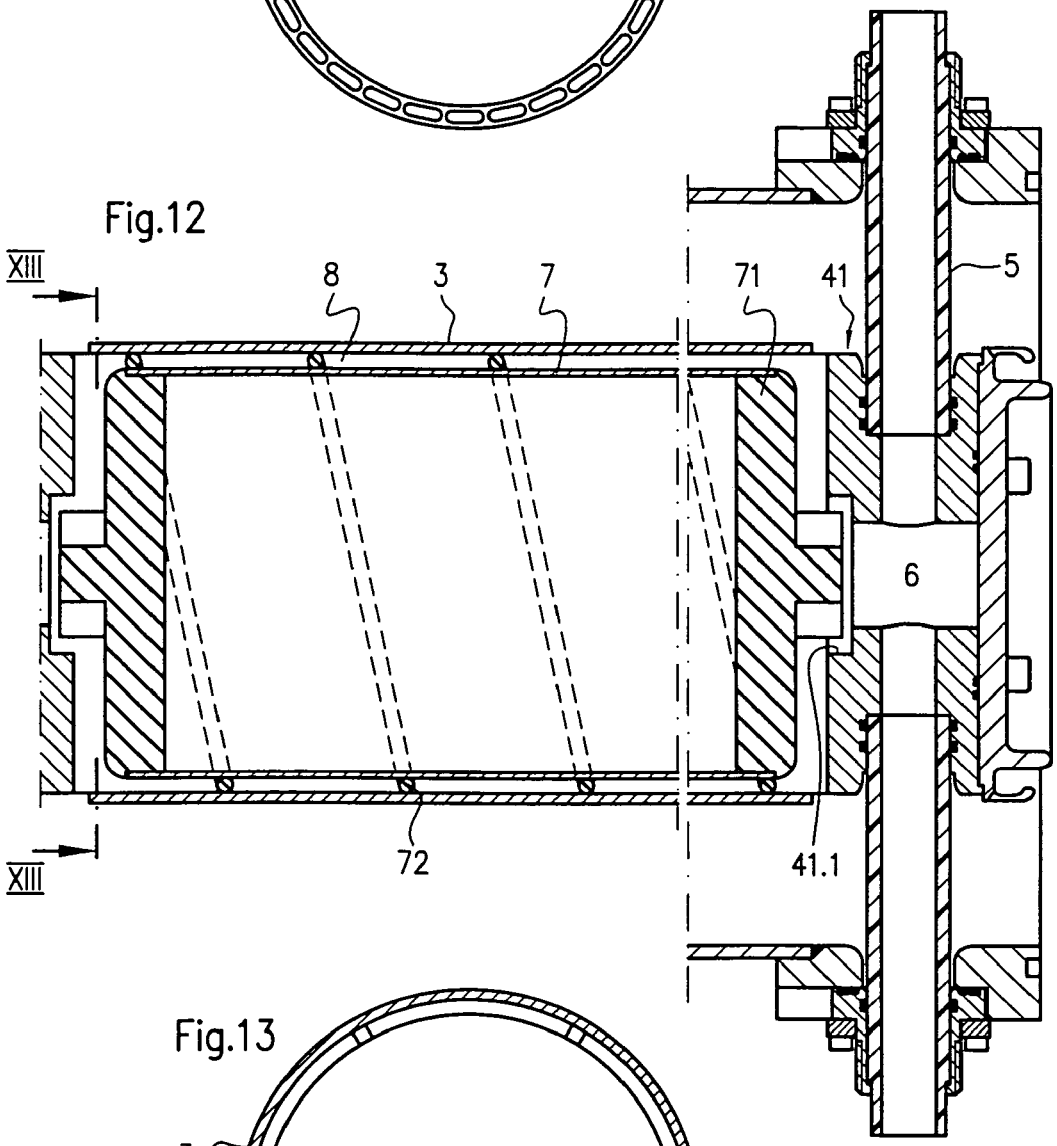
Fig.13
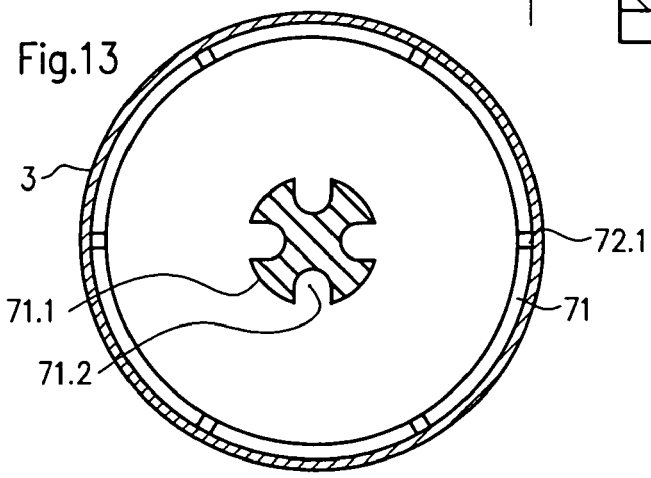

COAXIAL LINE HAVING FORCED COOLING

CROSS-REFERENCE TO RELATED APPLICATIONS

This application claims priority under 35 U.S.C. §119(a) from German Patent Application No. 103 15 021.8, filed Apr. 2, 2003, and from German Patent Application No. 103 22 482.3, filed May 19, 2003.

FIELD OF THE INVENTION

The present invention relates to a coaxial line having a tubular inner conductor, an outer conductor, insulating material struts between the inner conductor and the outer conductor and connections for conducting a coolant through the line.

BACKGROUND

Specific applications, e.g., in the field of plasma physics, require supplying HF currents of more than 1 MW using coaxial lines, whose diameter may not be made arbitrarily large for mechanical and/or HF technology reasons. Particularly in continuous wave mode, such a large quantity of heat per time unit therefore arises on the inner conductor, primarily because of ohmic losses, and in the region of the insulating material struts, primarily because of dielectric losses, that forced cooling is necessary. According to the related art, a gaseous medium is conducted through the annular space between the inner conductor and the outer conductor for forced cooling. However, the quantity of waste heat which may be dissipated in this way is limited, particularly because the pressure and therefore the flow speed of the gaseous coolant may not be increased arbitrarily for a variety of reasons. Liquid media have also previously been used for cooling superconducting coaxial cables, but extensive and costly secondary devices have been necessary for this purpose.

SUMMARY

The present invention is based on the object of providing a coaxial line having improved cooling capability.

This object is achieved according to the present invention in that the coolant may be conducted through the inner conductor.

As a consequence, significantly higher HF currents than before may be transmitted via the line at a given line diameter, both in pulse mode and in continuous wave mode, particularly if a liquid coolant is used.

The cooling of the outer conductor, which is significantly less thermally loaded, is not the object of the present invention. It may be performed using cooling ribs attached to the outer conductor, cooling hoses, or similar measures known per se.

The coolant may preferably be supplied and removed via conduits implemented in at least some of the insulating material struts.

These insulating material struts may be implemented as tubes led through the outer conductor toward the outside. Typically, three or four insulating material struts per radial plane, which are offset by 120° or by 90°, respectively, suffice. As a function of the coolant flow necessary, it may be sufficient to use only a part of these insulating material struts for supplying and removing the coolant. It is then to be ensured through suitable constructive implementation of the insulating material struts that no additional distortions of the HF field arise around the circumference.

Alternatively, the insulating material struts may also be implemented as hollow discs having radial conduits, in order to divide the line into sections which are sealed longitudinally, for example.

The conduits of the insulating material struts preferably discharge into a chamber in an inner conductor connecting element at the end of the tubular inner conductor. The inner conductor connecting element simultaneously forms the bearing for the particular end of the tubular inner conductor.

A preferred embodiment of the coaxial line is distinguished in that a tube of smaller diameter, which is sealed on its face on both ends, is positioned coaxially in the tubular inner conductor and the annular space between this tube and the tubular inner conductor communicates with the conduits in the insulating material struts. The coolant then only flows through the annular gap or annular space between the tubular inner conductor and the tube of smaller diameter, which is enclosed by the inner conductor and expediently also mounted at its ends on the relevant inner conductor connecting elements. If the annular cross-section is adequately dimensioned, the cooling effect remains practically unchanged, while simultaneously having a significantly lower weight of the line and a lower complexity of the secondary assemblies necessary for coolant circulation.

The face of the tube is expediently sealed by a flange implemented on the inner conductor connecting element.

Alternatively, the face of the tube may also be sealed via flanges which are mounted on the particular inner conductor connecting element so they float axially and radially. The play in the axial direction in particular avoids the occurrence of axial constraining forces, whether they are due to manufacturing tolerances or whether they are due to different heat-dependent length changes of the tube and the tubular inner conductor enclosing it.

In addition, the outer circumference of the tube may have centering elements which support it against the inner wall of the tubular inner conductor. In this way, it is ensured that the cross-section of the annular gap or annular space between the tubular inner conductor and the tube enclosed by it remains constant around the circumference, even if the coaxial line as a whole has a slight curve in the longitudinal direction.

The centering elements may be positioned along a spiral, i.e., in a screw shape around the tube, or even as individual elements spaced apart from one another.

Alternatively, the centering elements may include axially running webs. This is more favorable for flow technology than the positioning along a spiral.

In all embodiments, the centering elements may be in one piece with the tube . This is especially advantageous for manufacturing if the tube is made not of metal, but rather of plastic.

Alternatively, the tubular inner conductor may have axial conduits in its mantel which communicate with the conduits in the insulating material struts. An inner conductor of this type may, for example, be manufactured cost-effectively from aluminum as an extruded profile.

In the event of greater length, the coaxial line is made of sections, separately coolable from one another, which are connected to one another electrically and mechanically.

In this case, the tubular inner conductors of adjoining sections the line of may be best connected to one another via complementary plug-in connections.

Such a complementary plug-in connection may include a flange plate, which terminates the chamber of the particular inner conductor connecting element, having an axially extending first annular shoulder, which overlaps a second annular shoulder on the flange plate of the adjoining line section and is in turn overlapped to form a contact by a collar of axially extending contact springs, which encloses the second annular shoulder concentrically . The first annular shoulder forms a kind of plug and the second annular shoulder forms the complementary coupling together with the contact spring collar.

The free ends of the contact springs of the contact spring collar advantageously lie in a radial plane which is set back axially in relation to the radial plane containing the face of the second annular shoulder. In this way, when two line parts are put together, a pre-centering is achieved, in which the first annular shoulder overlaps the second annular shoulder before the face of the first annular shoulder comes to rest under the contact springs. In this way, damage to the contact springs and therefore contact which is not uniform around the circumference because of alignment errors is avoided, which would both lead to the occurrence of reflections and intermodulation products and result in overheating and possibly combustion of the contact surfaces at the currents to be transmiffed, which are several thousand amperes.

The flange plates carrying the contacting annular shoulders are expediently screwed onto the associated inner conductor connecting elements. This makes the refitting of the connection points from plugs to couplings and vice versa easier. Furthermore, the contact spring collar may be manufactured as a single part from the material best suited for this purpose. It is then welded to the flange plate at its root.

Since the tubular inner conductor has a significantly higher thermal load than the outer conductor, in spite of cooling, the thermal expansions arising must be taken into consideration. For this purpose, the insulating material struts may be led through the outer conductor so they float in the axial direction.

One possibility for this purpose is for the end of the insulating material strut led through the outer conductorto be enclosed by a guide flange, which is held in a recess of the outer conductor so it floats in the axial direction, is sealed in relation thereto so it is radially elastic, and is in contact therewith so it is radially elastic. The radially elastic seal may be produced using O-rings and the radially elastic contact may be implemented using an annular closed contact element, which is wound in a screw shape, a worm contact.

Instead of this, the inner end of each of the tubular insulating material struts may be mounted in the inner conductor connecting element and the outer end may be mounted in the outer conductor wall so they are tiltable in an axial plane. The tiltable mounting may be implemented, for example, through annular beads on the relevant ends of the insulating material struts in connection with counter bearings shaped like spherical caps in the relevant receivers on the inner conductor connecting element and at a bushing through the wall of the outer conductor.

BRIEF DESCRIPTION OF THE FIGURES

In the drawing, an exemplary embodiment of a coaxial line according to the present invention is shown.

FIG. 11 shows a front view of another embodiment of the inner conductor tube;

FIG. 12 shows a line section similar to FIG. 1, but in another embodiment;

FIG. 13 shows a section along the line XIII—XIII in FIG. 12.

DETAILED DESCRIPTION

Figure 1:
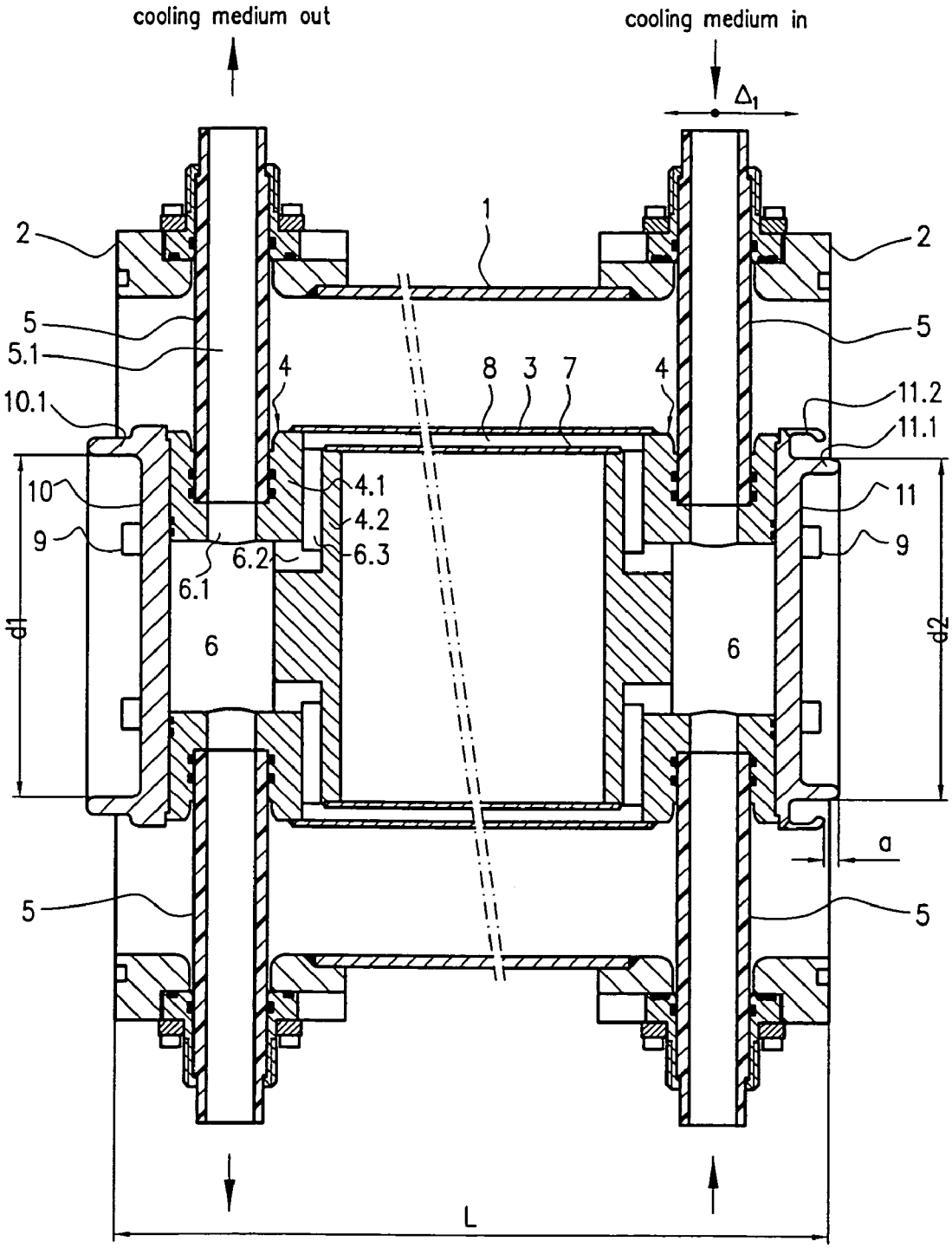
FIG. 1 shows a shortened line section in longitudinal section.
Figure 2:
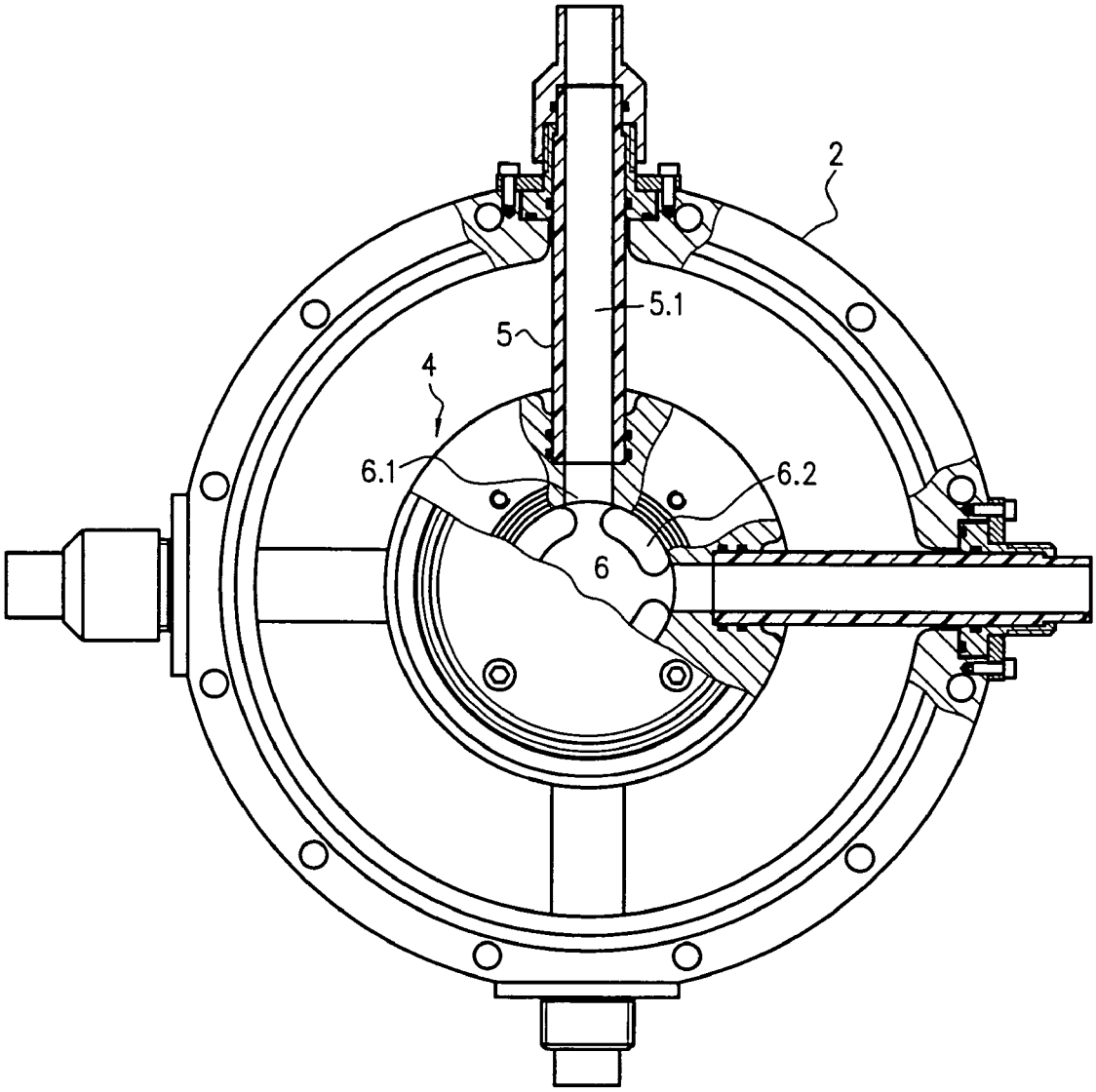
FIG. 2 shows a front view, partially in section.

FIG. 1 shows—shortened in the longitudinal direction—a section of a coolable coaxial line for transmitting very high HF currents. The line includes an outer conductor tube 1 which is equipped on both ends with connection flanges 2. The diameter of the outer conductor tube 1 may be in the range of 120 mm and more. The outer conductor 1 coaxially encloses a tubular inner conductor 3 which is provided on both ends with inner conductor connecting elements 4. Each of the inner conductor connecting elements 4 is mounted via insulating material struts 5 made of a suitable dielectric, preferably a ceramic material, in the corresponding connection flanges 2, and in this exemplary embodiment this occurs via four insulating material struts 5 each, as may be seen from FIG. 2. The insulating material struts 5 are arranged in tubular way and are led to the outside sealed by the connection flange 2. Their inner ends are seated in a sealed fashion (cf. the grooves shown for receiving O-rings) in depressions of the inner conductor connecting elements 4.

Chambers 6, which are connected via holes such as 6.1 to the conduits 5.1 in the insulating material struts 5, are implemented in the inner conductor connecting elements 4. The inner conductor connecting elements 4 have a first flange 4.1 which is overlapped by the particular end of the inner conductor tube 3. The relevant end of the inner conductor tube 3 is welded, preferably continuously around its peripheral seam, to this flange 4.1. Alternatively, an O-ring (not shown) may be provided between the circumference of the flange 4.1 and the end of the inner conductor tube 3.

A contact between the flange 4.1 and the inner conductor tube 3 which is technically perfect for HF is then additionally necessary. The inner conductor connecting elements 4 have a second flange 4.2 of smaller diameter at a distance axially from the first flange 4.1. This second flange is overlapped by the particular end of a tube 7 of smaller diameter, which is positioned coaxially in the inner conductor tube 3. This tube 7 is not in the field-filled space and therefore does not have to be made of metal. The coaxial annular space 8 between the tubular inner conductor 3 and the tube 7 communicates via holes 6.3 and openings 6.2 with the chamber 6 in the particular inner conductor connecting element 4 (see also FIG. 2).

A coolant which is preferably liquid such as water is fed via the connections of the insulating material struts 5, which are led out, at one end of the line section, then flows through the annular space 8 and is removed via the insulating material struts 5 at the other end of the line section. In this way, the tubular inner conductor 3 and the inner conductor connecting elements 4 are cooled from inside.

On its side facing away from the tubular inner conductor 2, each chamber 6 is terminated by a flange plate 10 and/or 11 which is connected to the inner conductor connecting element 4 via screws 9. The flange plate 10 on one end (left in FIG. 1) of the line section has an axially oriented annular shoulder 10.1 having an internal diameter d1. The flange plate 11 on the other end (right in FIG. 1) of the line section has an annular shoulder 11.1 having the smaller external diameter d2<d1. A contact spring collar 11.2, which coaxially encloses the annular shoulder 11.1, is connected to the flange plate 11. The free ends of the contact springs lie in a radial plane which is set back by an axial distance a from the radial plane which contains the face of the annular shoulder 11.1.

Figure 3:
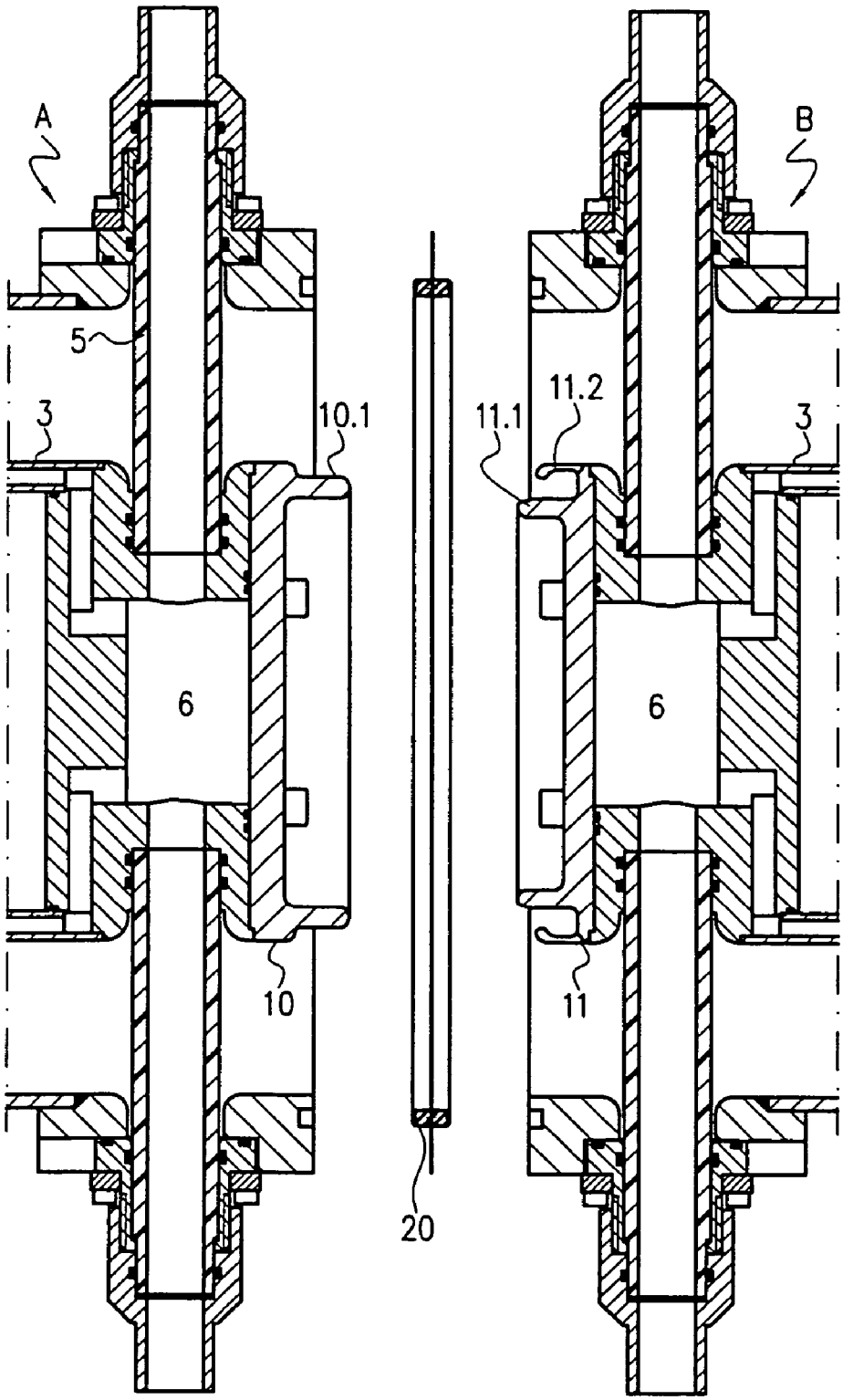
FIG. 3 shows the end regions of two sequential line sections, which are intended for connection to one another.
Figure 4:
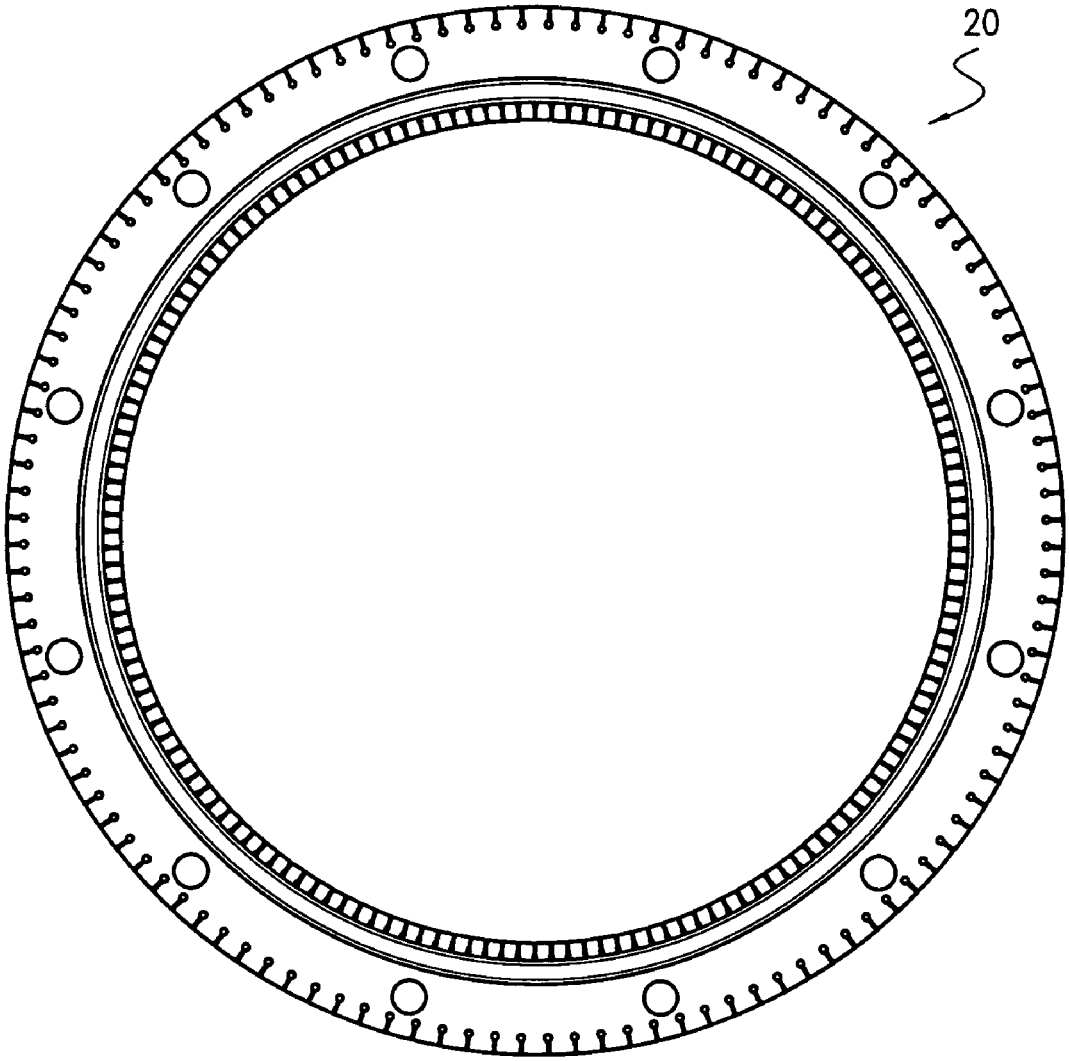
FIG. 4 shows a view of the seal and contact rings between the connection flanges of the outer conductor shown in FIGS. 3 and 5.

FIG. 3 illustrates that when two line sections A and B are put together, the annular shoulder 10.1 forms a plug element and the annular shoulder 11.1, together with the contact spring collar 11.2, forms a coupling element for implementing the contacting connection between the tubular inner conductors 3 of the line parts A and B which are put together. For transversely sealed, contacting connection of the outer conductor 1, the ring 20 made of a spring sheet metal shown in FIG. 4 is inserted between the connection flanges 2.

Figure 5:
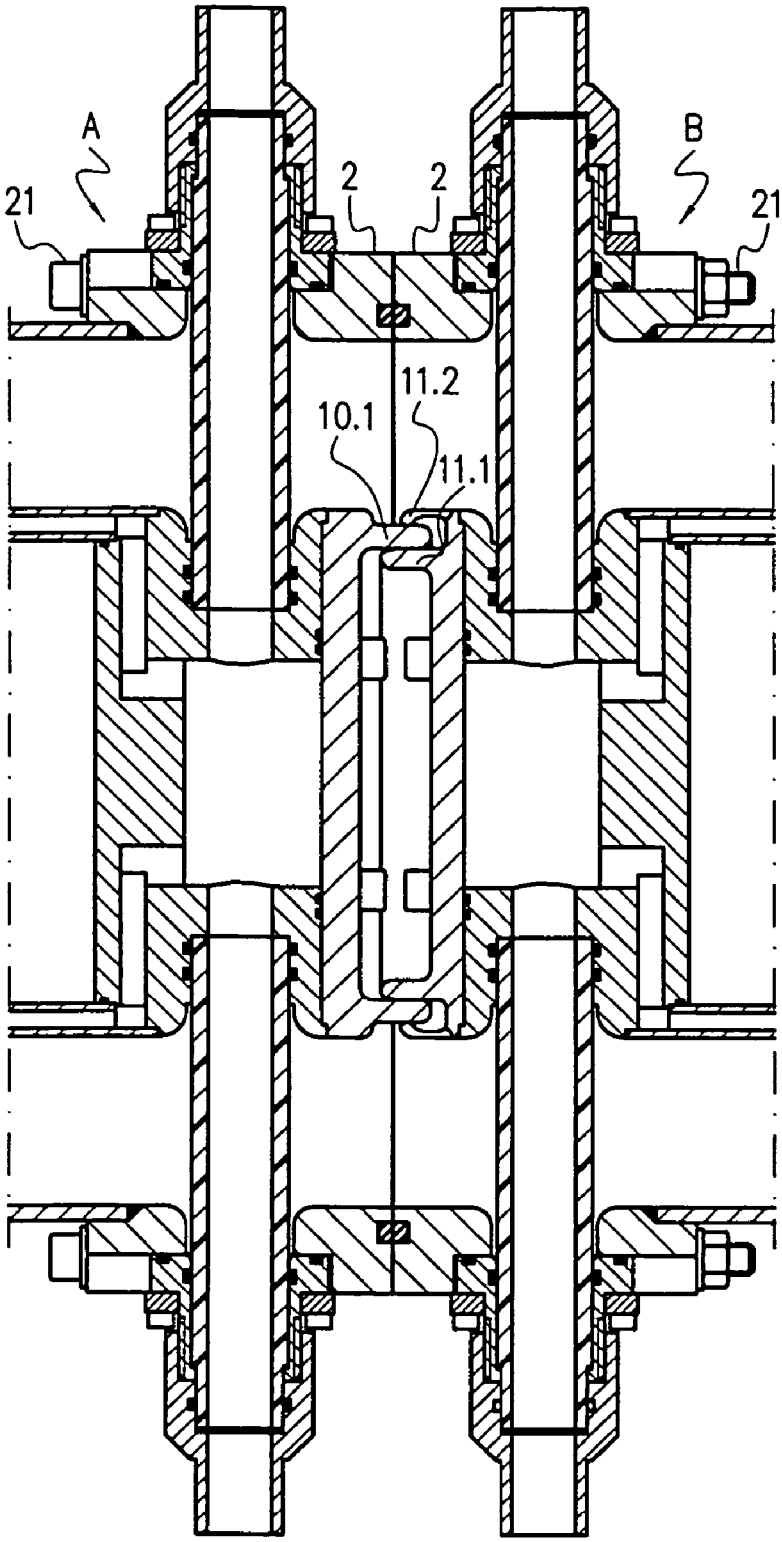
FIG. 5 shows the same end regions as in FIG. 3 after production of the connection.

In FIG. 5, the line sections A and B are shown in the state connected to one another. The outer conductor connection flanges 2 are, as is typical, screwed together via tie rods 21. The annular shoulders 10.1 and 11.1 form, together with the contact spring collar 11.2, a complementary plug-in connection for the tubular inner conductor. In order that sufficient cooling is also ensured in the region of these inner conductor plug-in connections 10.1, 11.1, 11.2, they are manufactured short in the axial direction, from materials which have good thermal conductivity, and in a sufficient material strength.

Figure 6:
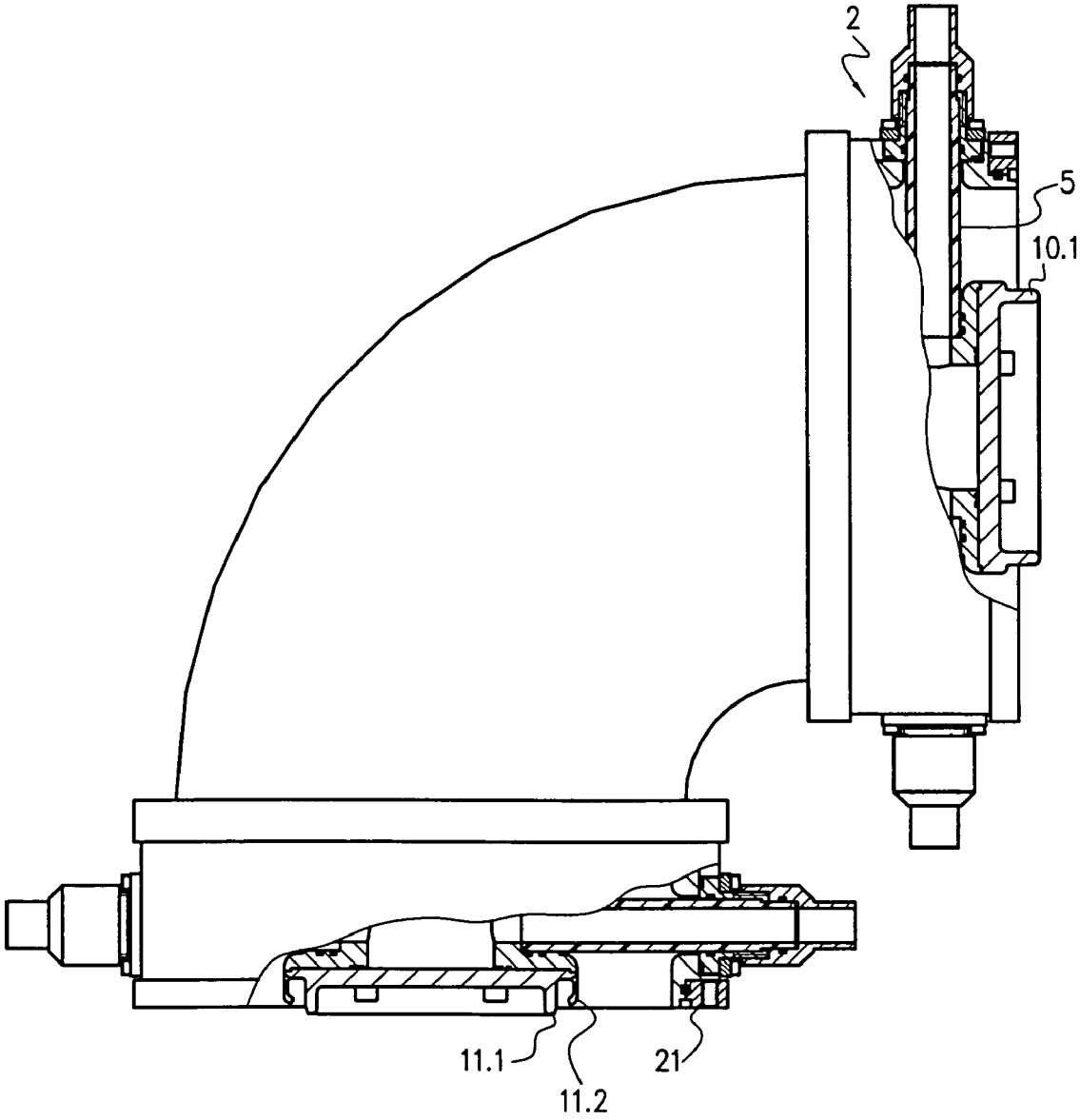
FIG. 6 shows a side view of a line section implemented as a 90° curve, partially in section.

Direction changes in the course of the line are implemented using elbows or line curves which have the same construction in principle as the straight line sections in FIG. 1. A 90° curve is shown in FIG. 6. To achieve a further degree of freedom, the outer conductor connection flanges 2 are additionally equipped in this case with ball bearings 21 in a manner known per se. No further measures are necessary on the inner conductor plug-in connection, because the plug part (10.1) and the coupling part (11.1, 11.2) may be twisted arbitrarily in relation to one another.

Figure 7:
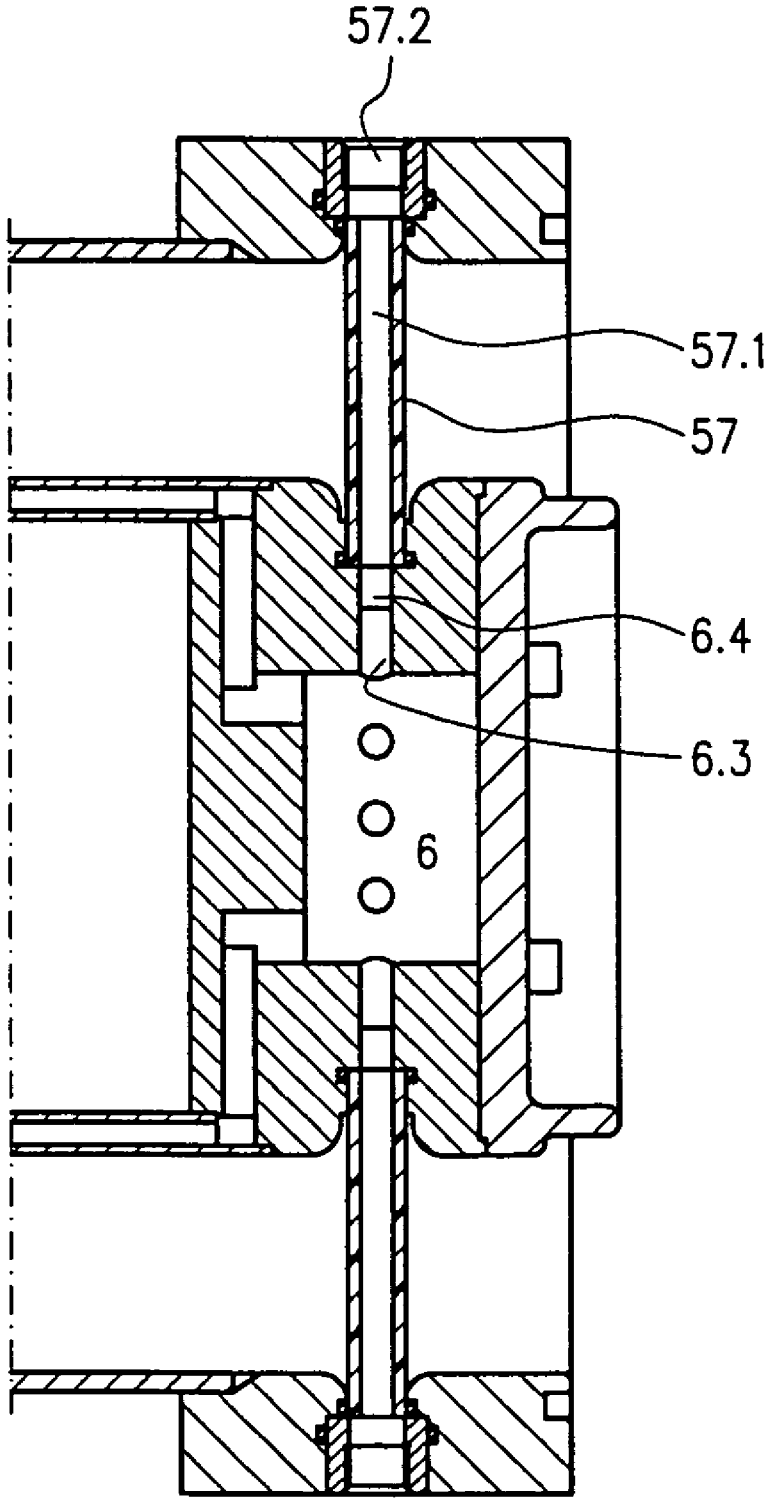
FIG. 7 shows the end region of a line section in longitudinal section having an alternative embodiment of the insulating material struts.

If the field-filled space between the outer conductor and the inner conductor is to be or must be pressurized with gas, e.g., $N_2$, during operation of the line, longitudinally sealed connections are necessary at specific points of the line. Full disks 57 made of ceramic are then used instead of the tubular insulating material struts, as shown in FIG. 7. These have a sufficient number of radial conduits 57.1 for introducing or removing the coolant. The conduits 57.1 communicate around the outer circumference with an annular conduit 57.2 and around the inner circumference with an annular conduit 6.4, which communicates via the holes 6.3 with the chamber 6 in the inner conductor connecting element 4.

Figure 8:
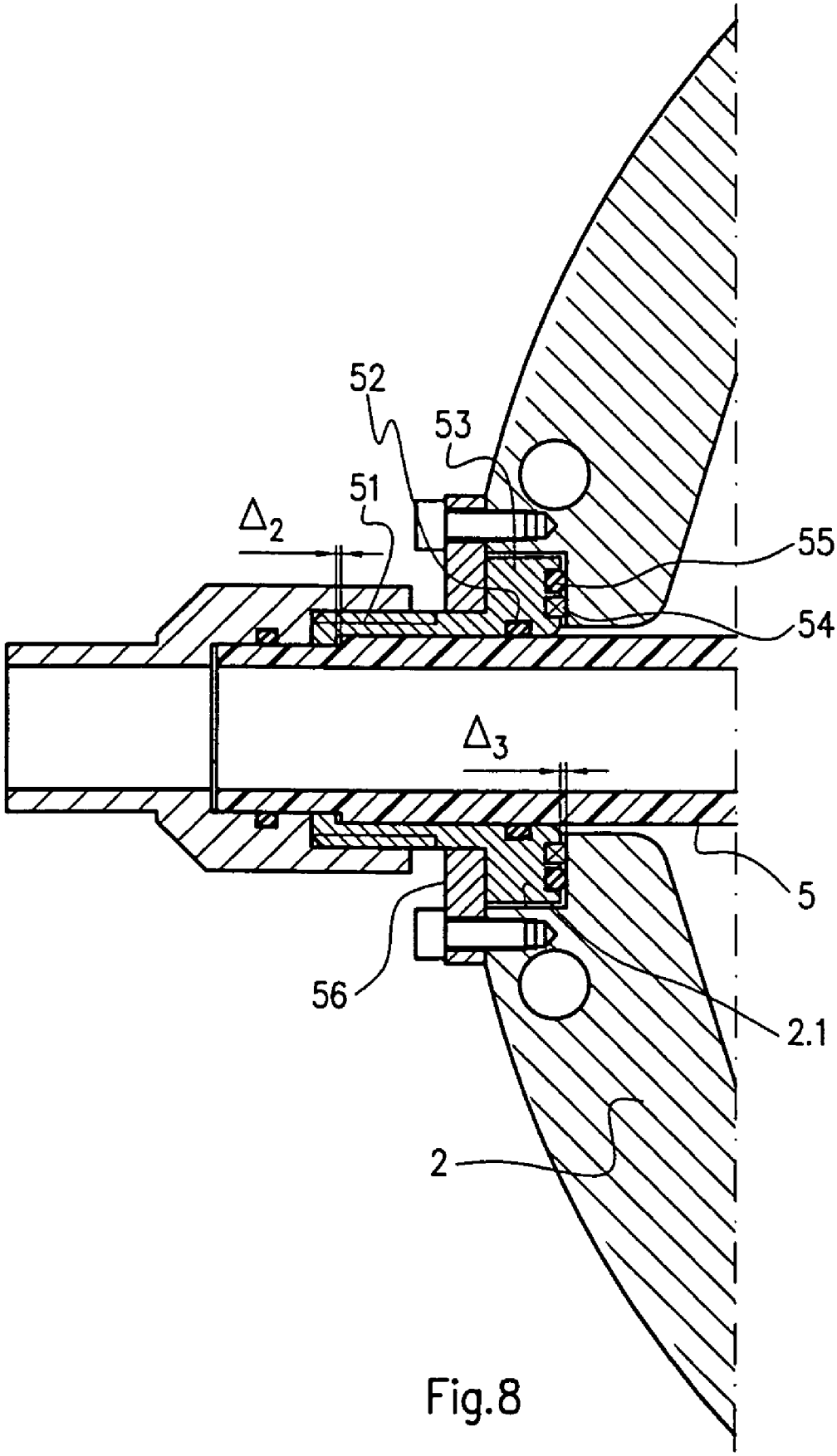
FIG. 8 shows the bushing of an insulating material strut through the outer conductor, predominantly in section and in enlarged scale as a front view.

In operation of the line, its inner conductor expands more strongly than the outer conductor in spite of cooling. A first possibility for absorbing this expansion, which is symbolically indicated in FIG. 1 with Δ1, is to lead the insulating material struts 5 through the wall of the outer conductor so they float. FIG. 8 shows such a sealed and HF-tight bushing. The tubular insulating material strut 5 is received in a sealed manner with an axial play Δ2 via an O-ring 52 in a guide sleeve 51, which sleeve is seated with its bottom flange 53 in a recess 2.1 in the wall of the outer conductor connection flange 2. The thickness of the bottom flange 53 is somewhat smaller than the depth of the recess. A worm contact 54, which is elastic in the radial direction, is received in a groove of the bottom flange 53. The worm contact is enclosed in turn by an O-ring 55. A gap Δ3 remains. The bottom flange 53 of the guide sleeve 51 is secured in the recess 2.1 using a pressure plate 56. The recess 2.1 is implemented like an oblong hole perpendicularly to the plane of the drawing, i.e., in the longitudinal direction of the line, so that the insulating material struts 5, including the guide sleeve 51, may follow changes in length Δ1 of the tubular inner conductor 3 in relation to the outer conductor 1 caused by heat and no constraining forces arise. This type of bushing simultaneously also permits changes in length of the insulating material struts 5 in the radial direction caused by heat.

Figure 9:
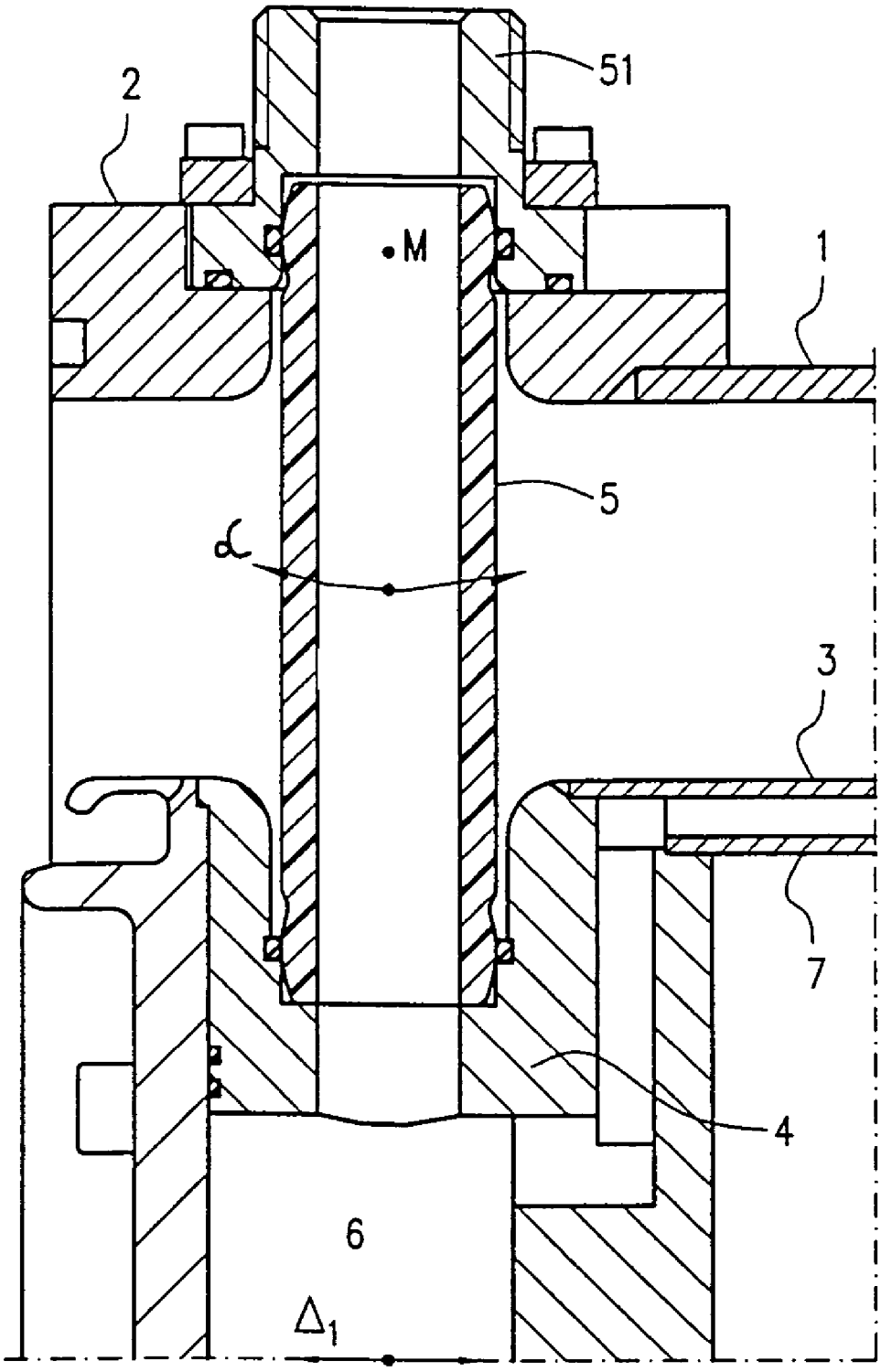
FIG. 9 shows another embodiment of the bushing of the insulating material strut in longitudinal section and in an enlarged scale.
Figure 10:
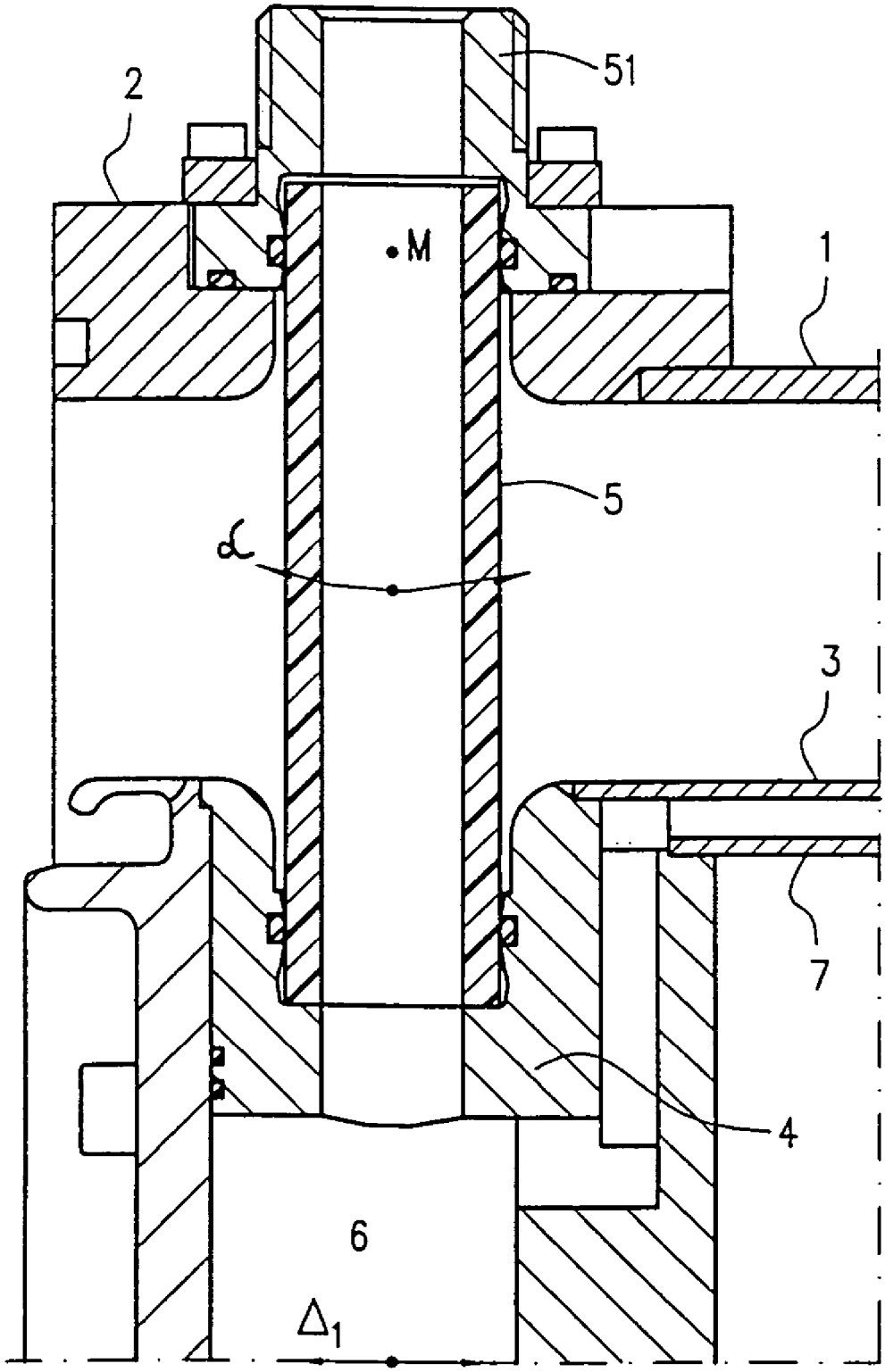
FIG. 10 shows an alternative embodiment to FIG. 9.

Another and simpler possibility for preventing the occurrence of constraining forces through changes in length of the inner conductor in relation to the outer conductor caused by heat is shown in FIGS. 9 and 10. The insulating material strut 5 is received in a pivoting way in the inner conductor connecting element 4 and in the guide sleeve 51, either through implementation of both its ends in the form of spherical caps in connection with sufficiently largely dimensioned recesses in the inner conductor connecting element 4 and in the wall of the outer conductor connection flange 2 (FIG. 9) or, complementary thereto, by implementing corresponding annular beads in the recesses of the ends of the insulating material struts 5 in the inner conductor connecting element 4 and additionally in the guide sleeve 51 (FIG. 10). In both cases, the insulating material sleeve may tilt around the point M by a small angle α.

In the embodiments described up to this point, the relatively thin, tubular inner conductor 3 is cooled by a coolant which flows through the annular space 8 provided using the tube 7 having a smaller diameter (cf. FIG. 1). Alternatively to this, the inner conductor may be implemented as a thick-walled tube 30 having numerous, closely neighboring axial conduits 31. FIG. 11 shows the corresponding cross-section. Such tubes may be manufactured very simply through an extrusion method, particularly from aluminum.

An embodiment altered from FIG. 1 is shown in FIG. 12. The tube 7 enclosed by the tubular inner conductor 3 is sealed on both ends by flanges 71, each of which has a central bearing pin 71.1 and with which it is seated in a recess 41.1 in the inner conductor connecting element 41 with play, particularly in the axial direction, but also in the radial direction. The radial play is shown exaggerated for the sake of clarity. The tube 7 is therefore mounted so it floats between the inner conductor connecting elements 41. The space 8 between the tubular inner conductor 3 and the tube 7 communicates with the particular chamber 6 in the inner conductor connecting element 41 via recesses 71.2 (cf. FIG. 13) in the pin 71.1 and the peripheral gap, adjoining in the radial direction, between the particular flange 71 and the face of the inner conductor connecting element 41 facing toward it. In order that the cross-section of the annular space 8 remains constant around the circumference, spacers or centering elements 72 are positioned between the tube 7 and the tubular inner conductor 3. These may enclose the tube 7 in a spiral shape in the way indicated in FIG. 12. The flow of the coolant then also runs in the space 8 in a spiral or screw shape. If this is to be avoided, the centering elements 72 must not be positioned continuously, but rather only in the form of short sections. Instead of this, the centering elements may also include axially running webs 72.1, as indicated in FIG. 13, so that the flow of the coolant remains aligned axially.

What is claimed is:

1. A coaxial line, comprising:

a tubular inner conductor;

an outer conductor;

a plurality of insulating material struts intersecting the outer conductor, wherein at least two of the insulating material struts each include a conduit in fluid communication with the inner conductor; and a plurality of connections for conducting a coolant through the coaxial line, wherein the conduits permit the coolant to be conducted through the tubular inner conductor.

2. The coaxial line according to claim 1, wherein the insulating material struts are arranged as tubes which are led outward through the outer conductor.

3. The coaxial line according to claim 2, wherein the end of each insulating material strut led through the outer conductor is enclosed by a guide flange, which is held in a recess of the outer conductor in a floating manner in the axial direction, is sealed radially elastically in relation thereto, and is in contact radially elastically therewith.

4. The coaxial line according to claim 1, wherein the insulating material struts are implemented as full disks having radial conduits.

5. The coaxial line according to claim 1, wherein the conduits of the insulating material struts open into a chamber in an inner conductor connecting element at the end of the tubular inner conductor.

6. The coaxial line according to claim 5, wherein a tube of smaller diameter, which is sealed on its face at both ends, is positioned coaxially in the tubular inner conductor, and wherein the annular space between said tube and the tubular inner conductor communicates with the conduits in the insulating material struts.

7. The coaxial line according to claim 6, wherein the tube is sealed on its face by a flange arranged on the inner conductor connecting element.

8. The coaxial line according to claim 6, wherein the tube is sealed on its face via flanges which are mounted on a particular inner conductor connecting element in an axially and radially floating manner.

9. The coaxial line according to claim 6, wherein the tube has centering elements on its outer circumference which rest on the inner wall of the tubular inner conductor.

10. The coaxial line according to claim 9, wherein the centering elements are positioned along a spiral around the tube.

11. The coaxial line according to claim 9, wherein the centering elements include axially extending webs.

12. The coaxial line according to claim 9, wherein the centering elements are of integral configuration with the tube.

13. The coaxial line according to claim 1, wherein the tubular inner conductor has axial conduits in its jacket which communicate with the conduits in the insulating material struts.

14. The coaxial line according to claim 1, further comprising: a plurality of sections which are separately coolable from one another and are connected electrically and mechanically to one another.

15. The coaxial line according to claim 14, wherein the tubular inner conductors of adjoining sections of the line are connectable to one another via complementary plug-in connections.

16. The coaxial line according to claim 15, wherein the complementary plug-in connection includes a flange plate, which terminates the chamber of the inner conductor connecting element and comprises an axially extending first annular shoulder which overlaps a second annular shoulder on a flange plate of an adjoining line section and is in turn overlapped to form a contact by a collar of axially extending contact springs which concentrically encloses the second annular shoulder.

17. The coaxial line according to claim 16, wherein the free ends of the contact springs of the contact spring collar lie in a radial plane which is set back axially in relation to the radial plane containing the face of the second annular shoulder.

18. The coaxial line according to claim 17, wherein the flange plates are screwed to the inner conductor connecting element.

19. The coaxial line according to claim 1, wherein the insulating material struts are led through the outer conductor, the insulating material struts floating in the axial direction.

20. The coaxial line according to claim 1, wherein each of the tubular insulating material struts is held tiltable in an axial plane with its inner end in the inner conductor connecting element and with its outer end in the outer conductor wall.

* * * * *